United States Patent [19]

La Bate

[11] 4,355,788

[45] Oct. 26, 1982

[54] HOT METAL RUNNER SYSTEM WITH AIR POLLUTION CONTROLS

[76] Inventor: Micheal D. La Bate, 115 Hazen Ave., Ellwood City, Pa. 16117

[21] Appl. No.: 273,018

[22] Filed: Jun. 12, 1981

Related U.S. Application Data

[63] Continuation-in-part of Ser. No. 133,356, Mar. 24, 1980, Pat. No. 4,300,753, which is a continuation-in-part of Ser. No. 123,369, Feb. 21, 1980, Pat. No. 4,262,885.

[51] Int. Cl.[3] ..... F27D 3/14

[52] U.S. Cl. ..... 266/157; 266/196; 266/236

[58] Field of Search ..... 266/231, 236, 196, 157

[56] References Cited

U.S. PATENT DOCUMENTS 3,942,473 3/1976 Chodash ..... 266/231
4,009,240 2/1977 Koenig ..... 266/157

FOREIGN PATENT DOCUMENTS 2025012 1/1980 United Kingdom ..... 266/281

*Primary Examiner*—M. J. Andrews
*Attorney, Agent, or Firm*—Harpman & Harpman

[57] ABSTRACT

A runner for hot metal as from a blast furnace is formed of a series of interconnected modular units which are prefabricated, preferably from refractory based materials. A plurality of flat slab-like covers are positioned continuously on the runners formed of the interconnected modular units so as to confine fumes, gas, smoke and other air pollutants. Live steam is introduced at selected locations along the runners to collect, absorb and mix with the fumes, gases and air pollutants. Vacuum devices in communication with the covered runners remove the air, steam and pollutants and direct them through scrubbers and/or precipitron equipment to remove the air pollutants before the air entrained in the system is released to the atmosphere.

8 Claims, 3 Drawing Figures

HOT METAL RUNNER SYSTEM WITH AIR POLLUTION CONTROLS

This application for patent is a continuation in part of my copending patent application on HOT METAL RUNNER SYSTEM WITH AIR POLLUTION CONTROLS, Ser. No. 133,356 filed Mar. 24, 1980, now U.S. Pat. No. 4,300,753 which was a continuation in part of Ser. No. 123369, filed Feb. 21, 1980, now U.S. Pat. No. 4,262,885.

BACKGROUND OF THE INVENTION

1. Field of the Invention

This invention relates to an improvement in hot metal runners as used in the metal producing industry for delivering molten metal from a source to a remote point and providing such hot metal runners with continuous enclosures and means for removing smoke, fumes, gases and the like therefrom to prevent air pollution.

2. Description of the Prior Art

Runners for handling hot metal are disclosed in U.S. Pat. No. 2,409,741 and such runners generally comprised metal shapes with clay liners as will be understood by those skilled in the art.

U.S. Pat. No. 3,174,739 relates to a nose for a furnace tap hole runner and wherein the nose, like the runners with which it is used, comprises a metal shape having a refractory lining in the nature of a permanent monolithic layer.

U.S. Pat. No. 3,365,187 shows a runner system for a blast furnace.

The runners in general use at the time of filing of U.S. Pat. No. 3,365,187 comprised clay shapes, some of which were carried in metal shapes and no runners are known in the art wherein a flat, slab-like cover formed of a series of prefabricated modular units was provided to cooperate with a series of prefabricated modular runner units to form a closed hot metal passageway so that the fumes, gases, smoke and other air pollutants inherent in the pouring and running of hot metal could be combined, mixed with live steam and eventually removed and separated from the atmosphere.

SUMMARY OF THE INVENTION

The present invention relates to an improvement in a hot metal runner system for hot metal sources such as blast furnaces, open hearths and the like, wherein the runners are arranged to provide a path for the fluid molten metal from the furnace to a pouring point such as into a tundish in communication with a continuous casting machine or to a ladle for subsequent pouring into ingot moulds or the like.

By providing hot metal runners with tight fitting, flat slab-like covers continuously therealong and means for injecting steam and removing the hot gases, smoke and fumes entrained therein from the closed hot metal runner system at spaced intervals therealong, the air pollution commonly associated with hot metal pouring floors and the like is almost completely eliminated as the fumes, smoke, gases and other air pollutants are efficiently removed from the hot metal runner system and separated and confined by scrubbers and/or precipitron equipment so as to prevent atmospheric air pollution.

DESCRIPTION OF THE PREFERRED EMBODIMENT

Figure 3:
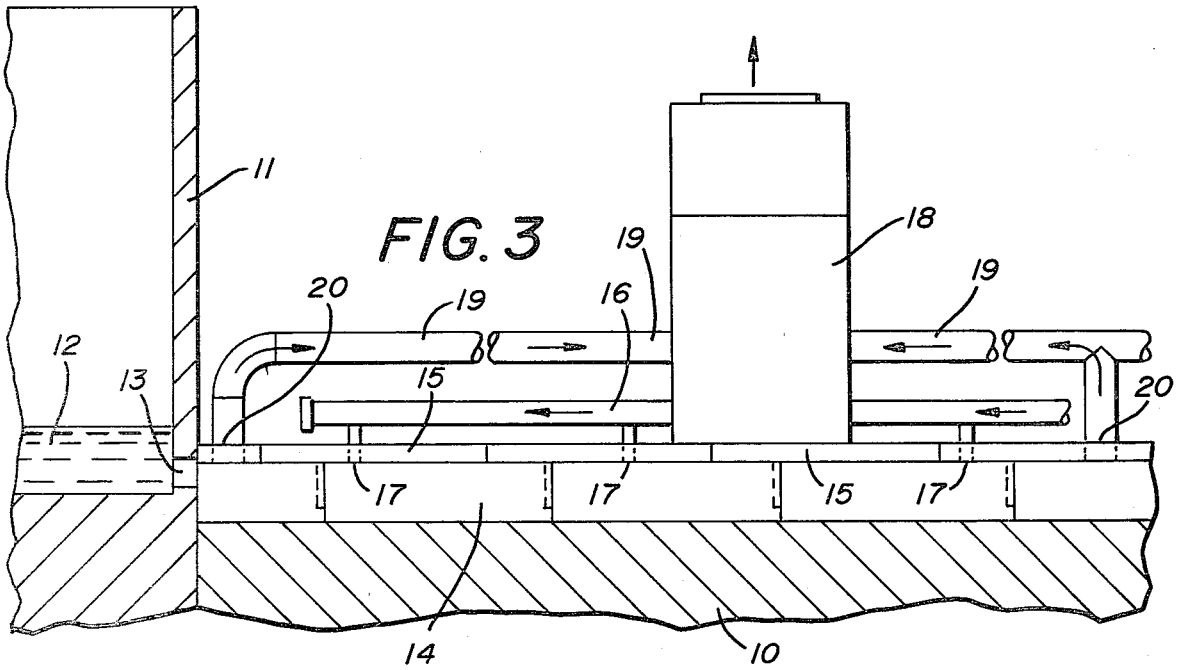
FIG. 3 is a symbolic side elevation of a source of hot metal, a runner system communicating therewith together with steam injecting air pollution controls.

By referring to the drawings and FIG. 3 in particular, it will be seen that a pouring floor is generally indicated at 10 and adjacent a source of hot metal such as molten iron in a blast furnace 11. Broken lines 12 in the source of hot metal 11 indicate molten metal therein. A tap hole 13 of the blast furnace or other source of hot metal 11 is shown in communication with a hot metal runner system arranged on the pouring floor 10 and comprising a plurality of trough shaped prefabricated modular runner units 14 of preferably refractory based materials such as clay rammed or packed and/or thermally influenced to form a coalesced mass having the desired density. A suitable material may be formed of a mixture of aluminum oxide, clay, refractory cement and phosphoric acid. A suitable refractory base mixture may comprise 81.5% by weight Mulcoa brand aluminum oxide, which is a mixture having 60% aluminum oxide, to this is added 13.5% raw fire clay and 5% pure aluminum oxide ($AL_2O_3$). This is combined with phosphoric acid ($H_3O_4P$) solution of 50% water and 50% phosphoric acid with the other ingredients in a ratio of 1.14 to 1. In this example, 88 lbs. of phosphoric acid solution is added to 100 lbs. of the above combined materials to produce a slurry suitable to be rammed or packed into moulds and dried. An alternate mixture is used in runners to receive slag at the end of an iron pour. Due to the increase corrosive properties of slag, a mixture comprising 46% by weight Mulcoa brand aluminum oxide, 31.25% silicon carbide, 10% powdered pure graphite, 12.7% fire clay combined with phosphoric acid solution as a binder in the same ratio as herein before described. In producing the modular runner units 14 of the invention, a mould is used to provide the desired trough-like shape into which the premixed material is positioned and compacted, preferably in layers to the desired density of the layers. Alternately, the runner units 14 maybe formed of any refractory from which fire bricks are made and then fired.

By referring to FIG. 3 of the drawings, it will be seen that several flat slab-like covers 15 are shown in position on the continuous row of runner units 14 so as to form a continuous enclosure with respect thereto and provide in effect a tunnel for the hot metal 12 flowing from tap hole 13 into the hot metal runner system. The covers 15 are formed of the same material as the runners 14 in a desired density. Means for introducing live steam and/or superheated steam at pressures in excess of atmospheric into the covered hot metal runners 14 may comprise a source of steam, a steam pipe 16 and communicating nozzles 17 as seen in FIG. 3 of the drawings.

An air moving device such as a vacuum machine 18 is illustrated in FIG. 3 of the drawings where it is in communication with a duct 19 which in turn communicates with an opening 20 in one of the flat, slab-like covers 15. Those skilled in the art will observe that more than one of the ducts 19 may be in communication with more than one of the openings 20 in the covers 15 if desired and depending upon the length of the hot metal runner system. Preferably the device for removing the steam and entrained fumes, smoke, dust, contaminated air and the like, from the hot metal runner system is spaced with respect to both the hot metal source, the steam injection nozzles 17 and the pouring end of the hot metal runner system so as to insure complete removal of the steam and entrained air pollutants from the system.

Still referring to FIG. 3 of the drawings, those skilled in the art will understand that the air moving device 18 includes a blower and a driving means, such as an electric motor, and that it may include means for removing pollutants from the steam and air moved therethrough. Such means which may be separately connected to the air moving device 18 may comprise scrubbers as known in the art or electrically actuated precipitron units, either of which will effectively remove smoke, gases, dust and other pollutants from the steam and air stream moved therethrough and thus avoid atmospheric pollution.

Figure 1:
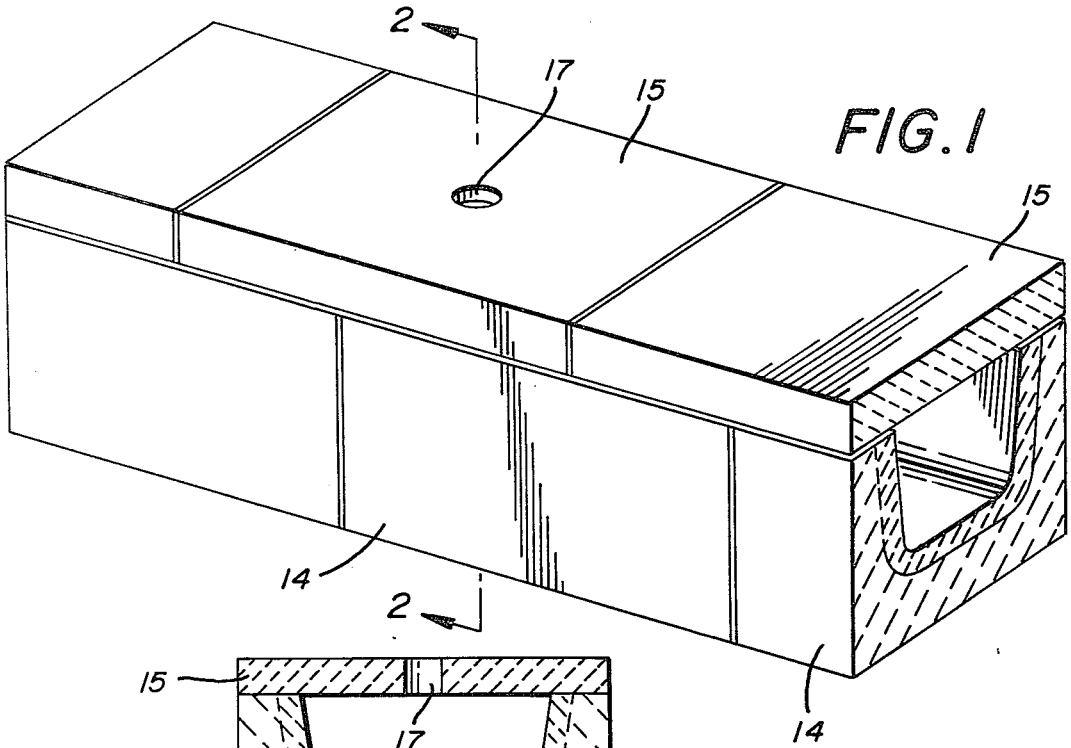
FIG. 1 is a perspective view of a portion of a hot metal runner system with air pollution control covers thereon.

By referring now to FIG. 1 of the drawings, it will be seen that the hot metal runner system shown in FIG. 3 is actually formed of a plurality of prefabricated modular runner units 14 in end to end alignment and it will occur to those skilled in the art that the end to end arrangement may have dove-tailed inter-engaging means not shown, if desired.

Figure 2:
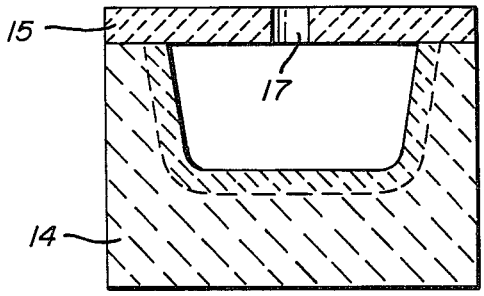
FIG. 2 is a vertical section on line 2—2 FIG. 1.

In FIGS. 1 and 2 of the drawings, it will be seen that the flat, slab-like covers 15 are preferably of a size to engage the upper edges of the walls of the trough-like prefabricated modular runner units 14, so as to close the same to contain the fumes, smoke and steam therein.

In FIG. 2 of the drawings, it will be seen that the cross sectional configuration of the trough-like runner units 14 and the slab-like covers 15 form a hot metal path through which the hot metal 12 from the source of hot metal 11 flows to a pouring point as will be understood by those skilled in the art. The use of the covers 15 keeps the hot metal approximately 30° hotter at the delivery point of the runner system than would be the case if the prior art uncovered runner systems were used.

In addition to the ability of the steam injecting hot metal runner system to control air pollution on hot metal pouring floors and the like, it has been determined that the improved hot metal runner system disclosed herein provides an efficient heat adding and insulating structure so that the runner 14 and cover 15 assemblies deliver the molten metal with a very small loss of temperature and which action contributes to the rapid flow of the molten metal without any pooling or freezing as is common in the use of present uncovered runners, thereby delivering all of the molten metal to the pouring point.

It will occur to those skilled in the art that various changes and modifications may be made in the invention disclosed herein without departing from the spirit thereof or from the scope of the appended claims and having thus described my invention what I claim is:

1. An improvement in a closed ferrous metal runner system for a hot metal pouring floor, said system extending from a source of molten metal to a pouring point thereof, the improvement comprising means for preventing air pollution of the pouring floor environment, said runner system comprising the combination of a plurality of elongated trough-like body members arranged in end to end relation, each of the members having an integral base with spaced parallel upstanding side sections and a plurality of elongated slab-like covers positioned in end to end relation on said plurality of trough-like body members arranged to prevent fluid communication between said covered trough-like members and the environment surrounding the same, said air pollution preventing means including means in communication with at least one opening in one of said covers for injecting live steam therein, said means for injecting live steam comprising a source of steam and a pipe communicating with said source of steam and said first mentioned opening and secondary means in communication with at least one opening in at least one of said covers for withdrawing said steam and entrained smoke, gas, air and air pollutants therefrom, said means for withdrawing said steam and entrained smoke, gas, air and air pollutants comprising a vacuum machine and a pipe communicating with said vacuum machine and with said second mentioned opening, said air pollution preventing means further including pollutant removal means in communicating relation with said air withdrawing means for separating said air pollutants from said steam and air.

2. The improvement in a closed hot metal runner system of claim 1 wherein each of said elongated troughlike body members is a mass coalesced by thermal influence with said coalesced mass being of a desired density and having a known predetermined lifetime when subjected to molten metal flowing therethrough.

3. The improvement in a closed hot metal runner system set forth in claim 2 and wherein the mass comprises material selected from those usable for fire bricks.

4. The improvement in a closed hot metal runner system set forth in claim 2 and wherein the mass is a refractory material such as clay.

5. The improvement in a closed hot metal runner system set forth in claim 1 and wherein each of said elongated troughlike body members is formed progressively of several layers, each compacted to a different degree of thickness and density.

6. The improvement in a closed hot metal runner system of claim 1 wherein each of said elongated troughlike body members is a mass coalesced by physical force and having a known predetermined lifetime when subjected to molten metal flowing therethrough.

7. The improvement in a closed hot metal runner system of claim 1 wherein each of said elongated troughlike body members is a mult-layered mass coalesced by physical force with each of said multi-layers being of a different density and having a known predetermined lifetime when subjected to molten metal flowing therethrough.

8. The improvement in a closed hot metal runner system set forth in claim 1 wherein said source of steam comprises a source of superheated steam.

* * * * *